US011438698B1

(12) United States Patent
Xu

(10) Patent No.: US 11,438,698 B1
(45) Date of Patent: Sep. 6, 2022

(54) DOUBLE-VOICE-COIL DOUBLE-MAGNETIC-CIRCUIT HIGH-FREQUENCY LOUDSPEAKER

(71) Applicant: Shenzhen Shengjiali Electronics Co., Ltd., Shenzhen (CN)

(72) Inventor: Huaidang Xu, Shaoyang (CN)

(73) Assignee: Shenzhen Shengjiali Electronics Co., Ltd., Shenzhen (CN)

( * ) Notice: Subject to any disclaimer, the term of this patent is extended or adjusted under 35 U.S.C. 154(b) by 0 days.

(21) Appl. No.: 17/587,026

(22) Filed: Jan. 28, 2022

(30) Foreign Application Priority Data

Dec. 2, 2021 (CN) ..... 202122997701.5

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2400/11* (2013.01)

(58) Field of Classification Search
CPC ..... H04R 9/025; H04R 9/06; H04R 2400/11
See application file for complete search history.

(56) References Cited

U.S. PATENT DOCUMENTS 8,825,124 B1 * 9/2014 Davies ..... H04M 1/185 455/575.8
11,290,825 B1 * 3/2022 Ko ..... H04R 9/06
2019/0268688 A1 * 8/2019 Yoo ..... H04R 7/02
2020/0389735 A1 * 12/2020 Yu ..... H01F 27/28

FOREIGN PATENT DOCUMENTS

CN 206596195 U 10/2017
CN 109733278 A 5/2019
CN 210579174 U 5/2020

* cited by examiner

*Primary Examiner* — Alexander Krzystan
*Assistant Examiner* — Julie X Dang

(57) ABSTRACT

The present invention discloses a double-voice-coil double-magnetic-circuit high-frequency loudspeaker, comprising a stand frame. At least two groups of magnetic circuits, which are symmetrically distributed with respect to a central axis in the horizontal direction of the stand frame, are arranged in the stand frame. With adoption of a design structure of a double-voice-coil double-magnetic-circuit resonant diaphragm, multiple vocal ranges can be provided to effectively increase a utilization rate of magnetic fields and improve sensitivity of the loudspeaker. In addition, production and assembly are facilitated to improve output power of a headset; and volume and voice quality can be controlled to provide ultra-high voice frequency, thereby creating truer vocal range expression.

3 Claims, 6 Drawing Sheets

DOUBLE-VOICE-COIL DOUBLE-MAGNETIC-CIRCUIT HIGH-FREQUENCY LOUDSPEAKER

CROSS-REFERENCE TO RELATED APPLICATIONS

The application claims priority to Chinese patent application No. 202122997701.5, filed on Dec. 2, 2021, the entire contents of which are incorporated herein by reference.

TECHNICAL FIELD

The present invention relates to the technical field of voice frequency equipment, in particular to a double-voice-coil double-magnetic-circuit high-frequency loudspeaker.

BACKGROUND

The loudspeakers on the market are all single-magnetic-circuit loudspeakers. Conventional compression high-tone loudspeakers are limited in high-frequency extension as a result of quality of voice diaphragms and voice coils, and high-voice distortion is caused by a dome dispersion pattern. With adoption of large and heavy single-voice-coil metal dome diaphragms, the conventional compression drivers are lower in integral output and power processing efficiency.

SUMMARY

To solve the technical defects in the background art, the present invention aims to provide a double-voice-coil double-magnetic-circuit high-frequency loudspeaker. With the adoption of a design structure of a double-voice-coil double-magnetic-circuit resonant diaphragm, multiple vocal ranges and ultra-high voice frequency are provided to create truer vocal range expression.

To achieve the objective, the present invention adopts a following solution.

A double-voice-coil double-magnetic-circuit high-frequency loudspeaker, comprising a stand frame in which a hollow cavity is arranged, wherein at least two groups of magnetic circuits are arranged in the stand frame; and each group of the magnetic circuits comprises magnets fitted to the inner wall of the stand frame, and voice coils positioned at sides of the inner walls of the magnets With the adoption of the technical solution, the design structure of the double-voice-coil double-magnetic-circuit resonant diaphragm is adopted to provide multiple vocal ranges, so that a utilization rate of the magnetic fields can be effectively increased. Ultrahigh voice frequency is provided to create truer vocal range expression.

Further, wherein at least two iron hoops which are symmetrically distributed with respect to a central axis in the horizontal direction of the stand frame are arranged between the two magnets.

With the adoption of the technical solution, the iron hoops interact with the magnets to effectively improve magnetic flux, so that the magnetic circuits are smoother. Furthermore, the voice quality of the loudspeaker is improved, and the magnets and a diaphragm are fixed.

Further, wherein a diaphragm is arranged between the two iron hoops, and gaps are formed between the diaphragm and the magnets, and between the diaphragm and the voice coils.

With adoption of the technical solution, the loudspeaker is higher in sensitivity and convenient in use.

Further, wherein a through hole is formed in one side of the stand frame; a flexible circuit board (FPC) is arranged in the stand frame through the through hole the FPC penetrates through the through hole; one end of the FPC fits to the inner wall of the other side with the through hole on the stand frame, and the other end of the FPC extends along one side of the outer wall of a supporting frame.

With adoption of the technical solution, circuit connection of the loudspeaker is achieved.

Further, wherein a gasket is arranged on the stand frame, and a gap is formed between the gasket and the FPC.

With adoption of the technical solution, damping effect is achieved to ensure the sound effect of the loudspeaker to be unaffected.

Further, wherein a capacitor) is arranged on the top of the stand frame; and the capacitor fits to one end of the FPC and is positioned at sides of the inner walls of the voice coils.

With the adoption of the technical solution, a low-frequency signal is filtered out, so that power load characteristics are better, and the loudspeaker can be ensured to smoothly transmit the voice without distortion.

Further, wherein a rubber frame is arranged at one side of the outer wall of the stand frame.

With the adoption of the technical solution, elements inside the loudspeaker are protected; and the voice can be effectively reflected to achieve the noise reduction effect.

Further, wherein a tone tuning net which is positioned on the bottoms of the voice coils is arranged on the rubber frame; and the tone tuning net fits to the outer wall of the stand frame.

With the adoption of the technical solution, the voice quality can be effectively improved, noises are blocked, and volume and voice quality are controlled. Meanwhile, invasion of other things or dust in air can be prevented to achieve certain protection effect on the loudspeaker.

In summary, the present invention achieves the following technical effects:

With adoption of the design structure of the double-voice-coil double-magnetic-circuit resonant diaphragm, multiple vocal ranges can be provided to effectively increase the utilization rate of magnetic fields and improve sensitivity of the loudspeaker. In addition, production and assembly are facilitated to improve output power of a headset; and volume and voice quality can be controlled to provide ultra-high voice frequency, thereby creating truer vocal range expression.

DETAILED DESCRIPTION OF THE EMBODIMENTS

The embodiments of the present invention will be described in detail in conjunction with the FIG. 1 to FIG. 2.

Embodiment I

Figure 1:
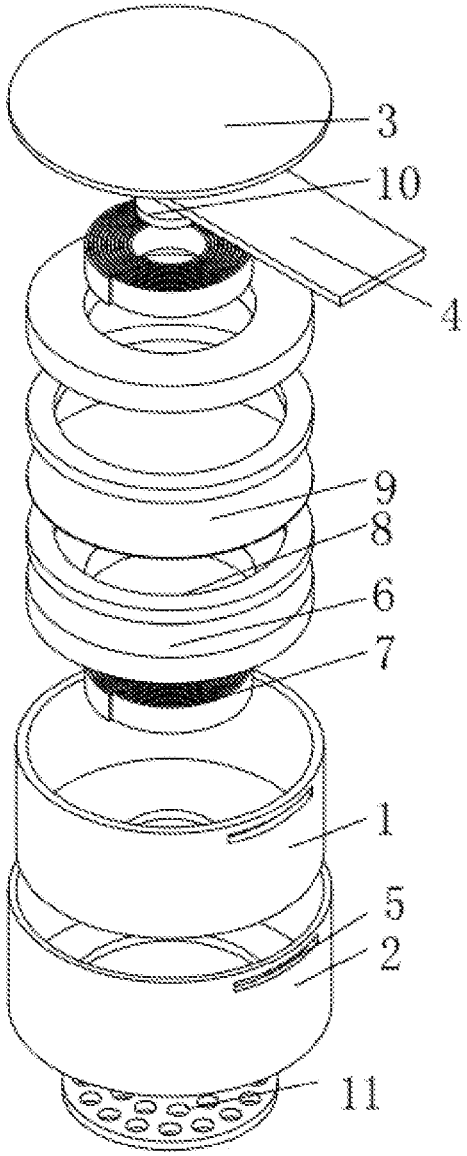
FIG. 1 is a schematic diagram showing an explosion structure in specific embodiment of the present invention.

As shown in FIG. 1, a double-voice-coil double-magnetic-circuit high-frequency loudspeaker includes a stand frame 1 in which a hollow cavity is arranged, and a rubber frame 2 is arranged at one side of the stand frame 1. The rubber frame 2 covers the outer wall of the stand frame 1 to protect elements inside the loudspeaker. Meanwhile, the voice can be effectively reflected to achieve the noise reduction effect. A gasket 3 further can be arranged at one side of the stand frame 1 to achieve damping effect to ensure the sound effect of the loudspeaker to be unaffected.

A through hole 5 is formed in one side of the stand frame 1 and one side of the rubber frame 2. A FPC4 which penetrates through the stand frame 1 and the rubber frame 2 is arranged in the stand frame 1 through the through hole 5. The length of the FPC4 is greater than that of the diameter of the stand frame 1, one end of the FPC4 fits to the inner wall of the other side with the through hole 5 of the stand frame 1, and the other end of the FPC4 extends along one side of the outer wall of a supporting frame. The loudspeaker achieves circuit connection through the FPC4, and the gasket 3 is arranged at one side, towards the FPC4, of the stand frame 1. A gap is formed between the gasket 3 and the FPC4 to achieve the damping effect, so that the sound effect of the loudspeaker is ensured to be unaffected.

At least two groups of magnetic circuits are arranged in the stand frame 1. In the embodiment, two groups of magnetic circuits which are symmetrically distributed with respect to a central axis in the horizontal direction of the stand frame 1 are arranged in the stand frame 1. Each group of the magnetic circuits includes magnets 6 fitted to the inner wall of the stand frame 1, and voice coils 7 at sides of the inner walls of the magnets 6. At least two iron hoops 8 are arranged between the two magnets 6. A diaphragm 9 is clamped between the two iron hoops 8, and gaps are formed between the diaphragm 9 and the magnets 6 and between the diaphragm 9 and the voice coils 7. The diaphragm 7 is connected to the voice coils 7. The diaphragm 9 is a flat-plate diaphragm. In the embodiment, the magnets 6, the voice coils 7 and the iron hoops 8 are all of annular structures, so that mounting and use are convenient.

Figure 2:
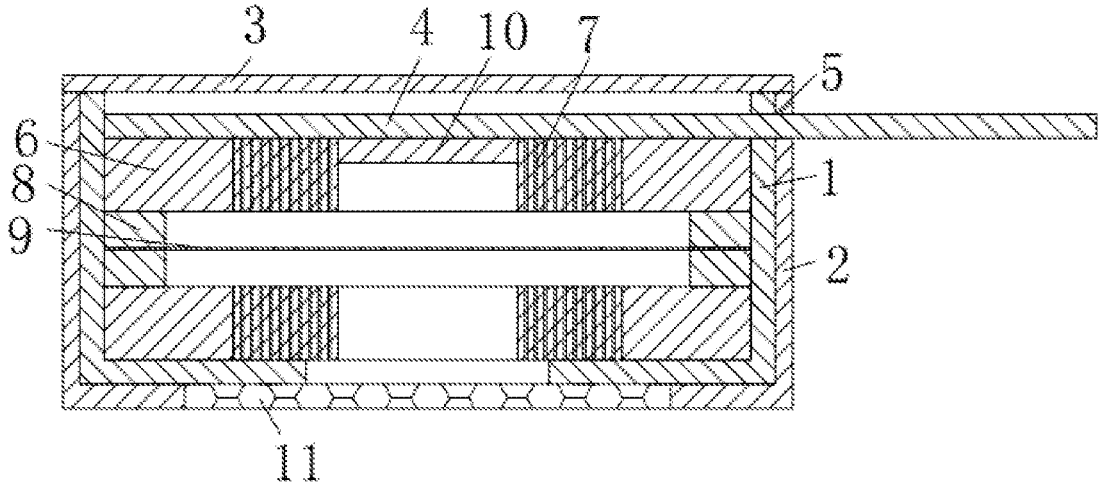
FIG. 2 is a schematic diagram showing a section-view structure in specific embodiment of the present invention.

As shown in FIG. 2, to ensure the loudspeaker to smoothly transmit voice without distortion and improve the voice quality effect, a capacitor 10 is arranged on the top of the stand frame 1. The capacitor 10 fits to one end of the FPC and is positioned at sides of the inner walls of the voice coils 7. A low-frequency signal can be filtered out through the capacitor 10, so that power load characteristic is better. In the embodiment, two iron hoops 8 are symmetrically distributed with respect to the central axis in the horizontal direction of the stand frame 1, and interact with the magnets 6, so that magnetic flux is effectively improved, and the magnetic circuits are smoother. Meanwhile, the magnets 6 and the diaphragm 9 are fixed. A tone tuning net 11 which is positioned on the bottoms of the voice coils 7 and fits to the outer wall of the stand frame 1 is arranged on rubber frame 2, so that the voice quality can be effectively improved, the noises are blocked, and the volume and the voice quality are controlled. Meanwhile, invasion of other things or dust in air can be prevented to achieve certain protection effect on the loudspeaker.

The implementation principle in the embodiment of the present application is as follows: circuit connection of the loudspeaker is ensured through the FPC4, and the voice coils 7 generate alternating magnetic fields under action of current. The magnets 6 generate constant magnetic fields with invariant sizes and directions, and magnetic fields generated by the voice coils 7 are steadily changing in size and direction along with changes of voice frequency current. The magnetic fields interact with one another, so that the voice foils 7 move in a direction perpendicular to the current therein, and the diaphragm 9 is further driven to vibrate. The diaphragm 9 vibrates to cause vibration of air to make a voice. The loudspeaker adopts a design structure of a double-voice-coil double-magnetic-circuit resonant diaphragm, so that multiple vocal ranges can be provided to increase the utilization rate of the magnetic fields and improve the sensitivity of the loudspeaker, thereby creating truer vocal range expression.

Embodiment II

Figure 3:
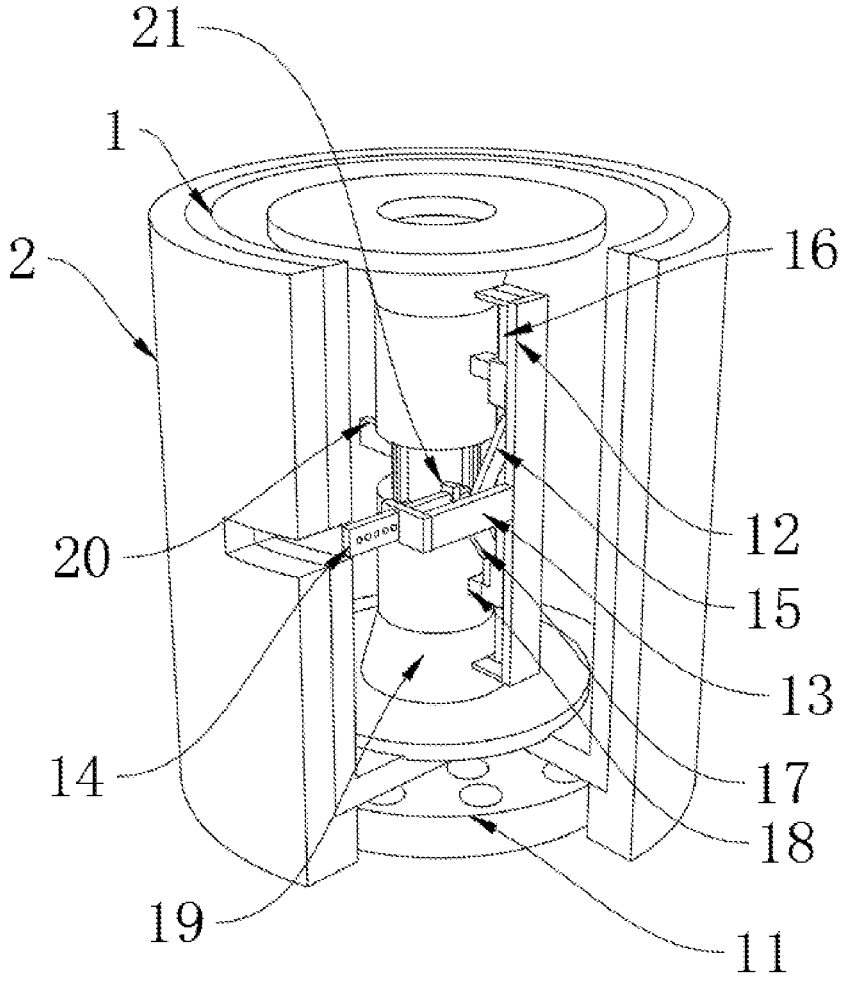
FIG. 3 is an overall schematic diagram in second specific embodiment of the present invention.
Figure 4:
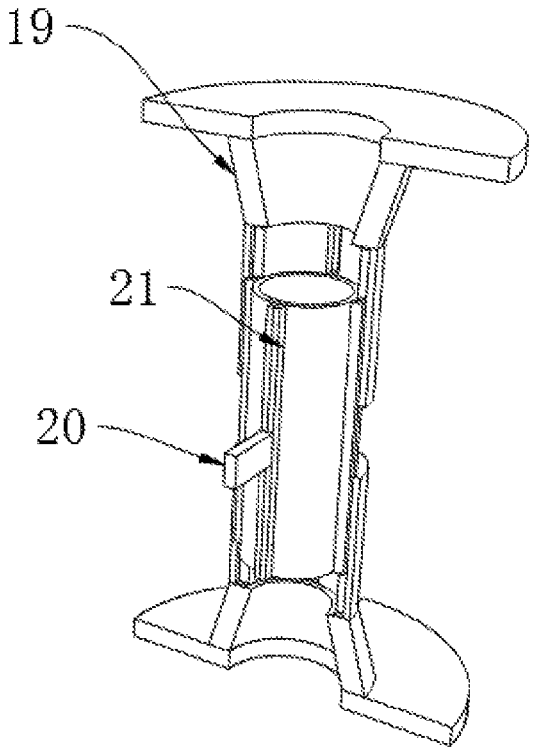
FIG. 4 is a section view of a second specific embodiment of the present invention.

As shown in FIG. 3 to FIG. 4, a double-voice-coil double-magnetic-circuit high-frequency loudspeaker includes a stand frame 1 in which a hollow cavity is arranged, and a rubber frame 2 is arranged at one side of the stand frame 1. The rubber frame 2 covers the outer wall of the stand frame 1 to protect elements inside the loudspeaker. Meanwhile, the voice can be effectively reflected to achieve the noise reduction effect. A gasket 3 further can be arranged at one side of the stand frame 1 to achieve damping effect to ensure the sound effect of the loudspeaker to be unaffected.

A through hole 5 is formed in one side of the stand frame 1 and one side of the rubber frame 2. A FPC4 which penetrates through the stand frame 1 and the rubber frame 2 is arranged in the stand frame 1 through the through hole 5. The length of the FPC4 is greater than that of the diameter of the stand frame 1, one end of the FPC4 fits to the inner wall of the other side with the through hole 5 of the stand frame 1, and the other end of the FPC4 extends along one side of the outer wall of a supporting frame. The loudspeaker achieves circuit connection through the FPC4, and the gasket 3 is arranged at one side, towards the FPC4, of the stand frame 1. A gap is formed between the gasket 3 and the FPC4 to achieve the damping effect, so that the sound effect of the loudspeaker is ensured to be unaffected.

At least two groups of magnetic circuits are arranged in the stand frame 1. The two groups of magnetic circuits which are symmetrically distributed with respect to a central axis in the horizontal direction of the stand frame 1 are arranged in the stand frame 1. Each group of the magnetic circuits includes magnets 6 fitted to the inner wall of the stand frame 1, and voice coils 7 at sides of the inner walls of the magnets 6. At least two iron hoops 8 are arranged between the two magnets 6. A diaphragm 9 is clamped between the two iron hoops 8, and gaps are formed between the diaphragm 9 and the magnets 6 and between the diaphragm 9 and the voice coils 7. The diaphragm 7 is connected to the voice coils 7. The diaphragm 9 is a flat-plate diaphragm. In the embodiment, the magnets 6, the voice coils 7 and the iron hoops 8 are all of annular structures, so that mounting and use are convenient.

The double-voice-coil double-magnetic-circuit high-frequency loudspeaker further includes a tone tuning tube module which is fixedly connected to the inner side of the hollow cavity. Preformed grooves are formed in the outer side of the stand frame 1 and the outer side of the rubber frame 2. The tone tuning tube module is arranged between the magnets 6 and to tone tuning net 11.

The tone tuning tube module includes an equipped carrying frame 12, an extending guide frame 13, a sliding push rod 14, a first folding push rod 15, a polish rod 16, a second folding push rod 17, transmitting slide blocks 18, extending tone-tuning barrels 19, an auxiliary positioning frame 20 and a sub-guide central slide rod 21. The auxiliary positioning frame 20 is fixedly connected to one side of the inner wall of the stand frame 1, and the equipped carrying frame 12 is fixedly connected to the other side of the inner wall of the stand frame 1. One side, away from the inner wall of the stand frame 1, of the auxiliary positioning frame 20 is welded with the sub-guide central slide rod 21. Equipped movable grooves are formed in positions corresponding to the auxiliary positioning frame 20 of the stand frame 1 and the rubber frame 2. The top end and the bottom end of the sub-guide central slide rod 21 are in sliding connection to the extending tone-tuning barrels 19. One end of the equipped carrying frame 12 is fixedly connected to the extending guide frame 13. The inner side of the extending guide frame 13 is in sliding connection to the sliding push rod 14. The sliding push rod 14 is in clearance fit to the preformed grooves. One side at one end of the sliding push rod 14 is rotatably connected to the first folding push rod 15, and the other side at one end of the sliding push rod 14 is rotatably connected to the second folding push rod 17. The inner side of the equipped carrying frame 12 is welded with the polish rod 16. The top end of the first folding push rod 15 and the bottom end of the second folding push rod 17 are fixedly equipped with the transmitting slide blocks 18. The transmitting slide blocks 18 are in sliding connection to the polish rod 16. One sides of the transmitting slide blocks 18 are fixedly connected to the extending tone-tuning barrels 19. A plurality of limiting holes are formed in the inner side of the sliding push rod 14. A limiting hole is formed in the inner side of the extending guide frame 13, and the inner side of the limiting hole is spliced with a locating pin.

The locating pin is withdrawn from the limiting hole through the equipped movable grooves, so that the sliding push rod 14 is not limited. The first folding push rod 15 and the second folding push rod 17 are stressed by pushing the sliding push rod 14 to rotatably unfold, so that the transmitting slide blocks 18 are pushed to slide under the guide of the polish rod 16. The transmitting slide blocks 18 slide to push the extending tone-tuning barrels 19 to accomplish displacement adjustment at different heights under guiding and limiting of the sub-guide central slide rod 21, so that tone tuning heights at different heights are formed, and even tone tuning with varying degrees is formed. Then, the locating pin is inserted into the limiting hole of the extending guide frame 13 and the limiting hole of the sliding push rod 14, so that the sliding push rod 14 and the extending guide frame 13 are fixed in a matched mode.

Embodiment III

Figure 5:
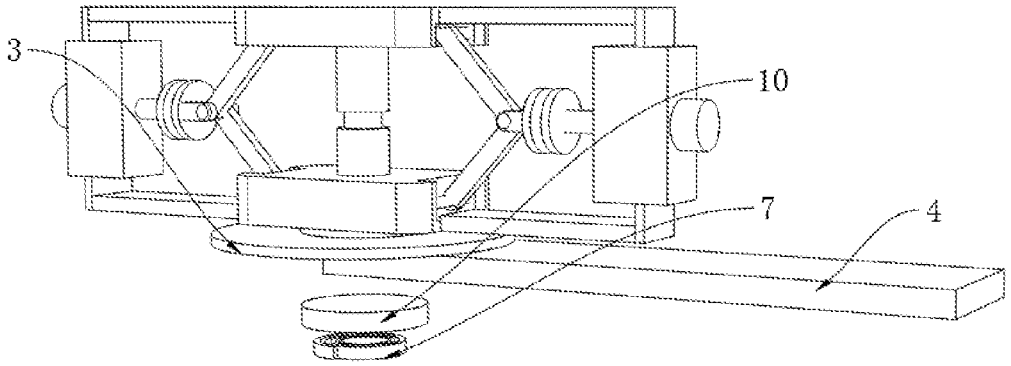
FIG. 5 is an overall schematic diagram in a third specific embodiment of the present invention.
Figure 6:
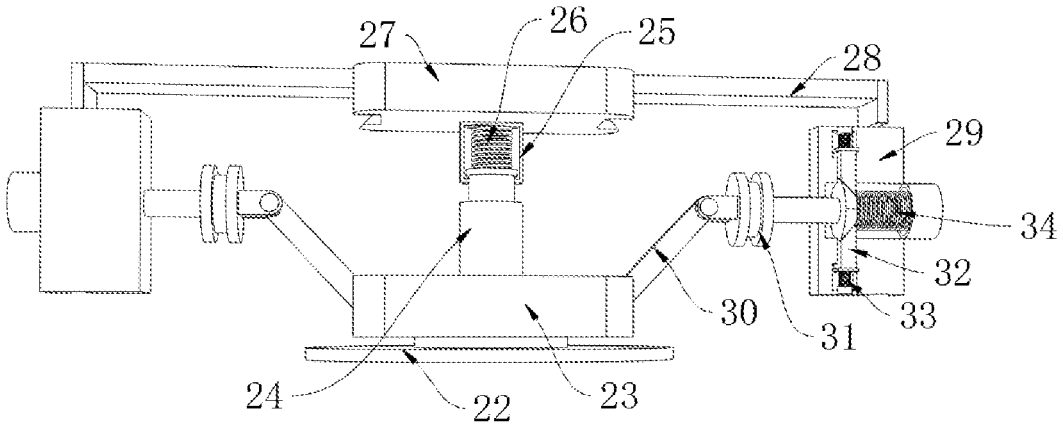
FIG. 6 is a section view of a third specific embodiment of the present invention.

As shown in FIG. 5 to FIG. 6, a double-voice-coil double-magnetic-circuit high-frequency loudspeaker includes a stand frame 1 in which a hollow cavity is arranged, and a rubber frame 2 is arranged at one side of the stand frame 1. The rubber frame 2 covers the outer wall of the stand frame 1 to protect elements inside the loudspeaker. Meanwhile, the voice can be effectively reflected to achieve the noise reduction effect. A gasket 3 further can be arranged at one side of the stand frame 1 to achieve damping effect to ensure the sound effect of the loudspeaker to be unaffected.

The gasket 3 includes a contact piece body 22, a pushing and guiding central block 23, a first push rod 24, an inner loading and unloading tube 25, a first spring 26, a limiting base 27, auxiliary carrying arms 28, an inner loading and unloading block 29, third folding push rods 30, a second push rod 31, a third push rod 32, second springs 33 and a third spring 34. The top end of the contact piece body 22 is fixedly connected to the pushing and guiding central block 23. The top end of the pushing and guiding central block 23 is fixedly connected to the first push rod 24. The outer side at the top end of the first push rod 24 is in sliding connection to the inner loading and unloading tube 25. The inner side of the inner loading and unloading tube 25 is welded with the first spring 26. The bottom end of the first spring 26 fits to the first push rod 24. The top end of the inner loading and unloading tube 25 is welded with the limiting base 27. The two sides of the limiting base 27 are welded with the auxiliary carrying arms 28. The bottom ends of the auxiliary carrying arms 28 are welded with the inner loading and unloading block 29. The two sides of the pushing and guiding central block 23 are rotatably connected to the third folding push rods 30. One sides of the third folding push rods 30 are rotatably connected to the second push rod 31. A flow-dividing groove and a central unloading groove are formed in the top end and the bottom end inside the inner loading and unloading block 29. One side of the second push rod 31 is in sliding connection to the inner side of the central unloading groove, and the inner side of the central unloading groove is fixedly connected to one side of the third spring 34. The other side of the third spring 34 fits to one side of the second push rod 31. The top end and the bottom end of the flow dividing groove are welded with the second springs 33. The top ends of the second springs 33 are welded with the third push rod 32. The third push rod 32 is in sliding connection to the flow dividing groove. The top end of the third push rod 32 fits to the outer surface of one side of the second push rod 31.

Vibration of sound waves is transmitted to the contact piece body 22, so that the vibration is transmitted to the pushing and guiding central block 23 through the contact piece body 22. The pushing and guiding central block 23 synchronously extrudes the third folding push rod 30 and the first push rod 24. The third folding push rod 30 moves to drive the second push rod 31, so that the second push rod 31 presses the third push rod 32 and the third spring 34. The third push rod 32 transmits stress to the second springs 23. The first push rod 24 slides inside the inner loading and unloading tube 25 so as to extrude the stress to the first spring 26. The first spring 26, the second springs 33 and the third spring 34 are matched, so that elastic potential energy is generated under stressed extrusion to balance out the stress. In such a manner, the sound waves are stable.

What is claimed is:

1. A double-voice-coil double-magnetic-circuit high-frequency loudspeaker, comprising a stand frame (1) in which a hollow cavity is arranged, wherein at least two groups of magnetic circuits are arranged in the stand frame (1); and each group of the magnetic circuits comprises magnets (6) fitted to the inner wall of the stand frame (1), and voice coils (7) positioned at sides of the inner walls of the magnets (6), wherein at least two iron hoops (8) which are symmetrically distributed with respect to a central axis in the horizontal direction of the stand frame (1) are arranged between the two magnets (6), wherein a through hole is formed in one side of the stand frame (1); a FPC (4) is arranged in the stand frame (1) through the through hole (5); the FPC (4) penetrates through the through hole (5); one end of the FPC (4) fits to the inner wall of the other side with the through hole (5) on the stand frame (1), and the other end of the FPC (4) extends along one side of the outer wall of a supporting frame.

2. The double-voice-coil double-magnetic-circuit high-frequency loudspeaker according to claim 1, wherein a gasket (3) is arranged on the stand frame (1), and a gap is formed between the gasket (3) and the FPC (4).

3. The double-voice-coil double-magnetic-circuit high-frequency loudspeaker according to claim 1, wherein a capacitor (10) is arranged on the top of the stand frame (1); and the capacitor (10) fits to one end of the FPC and is positioned at sides of the inner walls of the voice coils (7).

* * * * *